US009039152B2

(12) United States Patent
Kawabata et al.

(10) Patent No.: US 9,039,152 B2
(45) Date of Patent: May 26, 2015

(54) LIQUID CARTRIDGE AND IMAGE FORMING APPARATUS INCORPORATION SAME

(71) Applicants: Yoichi Kawabata, Kanagawa (JP); Masashi Ohnishi, Kanagawa (JP); Yuta Moriwaki, Kanagawa (JP); Yuta Kashiwagi, Kanagawa (JP); Shotaro Takeuchi, Kanagawa (JP)

(72) Inventors: Yoichi Kawabata, Kanagawa (JP); Masashi Ohnishi, Kanagawa (JP); Yuta Moriwaki, Kanagawa (JP); Yuta Kashiwagi, Kanagawa (JP); Shotaro Takeuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/471,180

(22) Filed: Aug. 28, 2014

(65) Prior Publication Data

US 2015/0077478 A1 Mar. 19, 2015

(30) Foreign Application Priority Data

Sep. 17, 2013 (JP) ..... 2013-191312

(51) Int. Cl.
*B41J 2/175* (2006.01)

(52) U.S. Cl.
CPC ..... *B41J 2/17546* (2013.01); *B41J 2/17553* (2013.01); *B41J 2/1753* (2013.01)

(58) Field of Classification Search
CPC ..... B41J 2/17546; B41J 2/17553; B41J 2/17559; B41J 2/17513; B41J 2/1753
USPC ..... 347/84–87
See application file for complete search history.

(56) References Cited

U.S. PATENT DOCUMENTS

| | | | | |
|---|---|---|---|---|
| 7,377,627 | B2 * | 5/2008 | Muranaka et al. | 347/86 |
| 8,147,046 | B2 * | 4/2012 | Yamashita | 347/86 |
| 2009/0256892 | A1 | 10/2009 | Takeuchi | |
| 2010/0171799 | A1 | 7/2010 | Takeuchi et al. | |
| 2011/0057997 | A1 | 3/2011 | Takeuchi | |
| 2014/0071211 | A1 | 3/2014 | Kawajiri et al. | |

FOREIGN PATENT DOCUMENTS

| | | |
|---|---|---|
| JP | 2011-051321 | 3/2011 |
| JP | 2012-226295 | 11/2012 |
| JP | 2014-054794 | 3/2014 |

* cited by examiner

*Primary Examiner* — Juanita D Jackson
(74) *Attorney, Agent, or Firm* — Cooper & Dunham LLP

(57) ABSTRACT

A liquid cartridge is detachably attachable to an apparatus body of an image forming apparatus. The liquid cartridge includes a cartridge case, an information memory element, and a holding unit. The cartridge case includes at least two dividable case parts. The at least two dividable case parts form a front face of the cartridge case to face the apparatus body when the liquid cartridge is attached to the apparatus body. An information memory element is held at the front face of the cartridge case. The holding unit is provided in one of the at least two dividable case parts to hold the information memory element with only the one of the at least two dividable case parts. The holding unit includes a groove to receive the information memory element and a displaceable claw to hold the information memory element between the groove and the claw.

6 Claims, 13 Drawing Sheets

LIQUID CARTRIDGE AND IMAGE FORMING APPARATUS INCORPORATION SAME

CROSS-REFERENCE TO RELATED APPLICATIONS

This patent application is based on and claims priority pursuant to 35 U.S.C. §119(a) to Japanese Patent Application No. 2013-191312, filed on Sep. 17, 2013, in the Japan Patent Office, the entire disclosure of which is incorporated by reference herein.

BACKGROUND

1. Technical Field

Embodiments of this disclosure relate to a liquid cartridge and an image forming apparatus incorporating the liquid cartridge.

2. Description of the Related Art

Image forming apparatuses are used as, for example, printers, facsimile machines, copiers, plotters, or multi-functional devices having two or more of the foregoing capabilities. As one type of image forming apparatus, there is known an inkjet recording apparatus serving as an image forming apparatus of a liquid-ejection recording system. The inkjet recording apparatus uses a recording head including a liquid ejection head (i.e., a droplet ejection head) for ejecting, for example, droplets.

A liquid cartridge such as an ink cartridge detachably attached to the above-described image forming apparatus is provided with an information memory element such as an identification (hereinafter abbreviated as "ID") chip for storing therein the type, remaining amount, and use amount of liquid to be contained.

For example, a liquid container includes a cartridge case having bisected case parts. The bisected case parts constitute a holding part to hold an ID chip serving as an information memory element. The ID chip is fixed by, for example, a double-sided tape or thermal welding.

BRIEF SUMMARY

In at least one embodiment of this disclosure, there is provided an improved liquid cartridge detachably attachable to an apparatus body of an image forming apparatus. The liquid cartridge includes a cartridge case, an information memory element, and a holding unit. The cartridge case includes at least two dividable case parts. The at least two dividable case parts form a front face of the cartridge case to face the apparatus body when the liquid cartridge is attached to the apparatus body. An information memory element is held at the front face of the cartridge case. The holding unit is provided in one of the at least two dividable case parts to hold the information memory element with only the one of the at least two dividable case parts. The holding unit includes a groove to receive the information memory element and a displaceable claw to hold the information memory element between the groove and the claw.

In at least one embodiment of this disclosure, there is provided an improved image forming apparatus including an apparatus body and a liquid cartridge. The liquid cartridge is detachably attached to the apparatus body. The liquid cartridge includes a cartridge case, an information memory element, and a holding unit. The cartridge case includes at least two dividable case parts. The at least two dividable case parts form a front face of the cartridge case to face the apparatus body when the liquid cartridge is attached to the apparatus body. The information memory element is held at the front face of the cartridge case. The holding unit is provided in one of the at least two dividable case parts to hold the information memory element with only the one of the at least two dividable case parts. The holding unit includes a groove to receive the information memory element and a displaceable claw to hold the information memory clement between the groove and the claw.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
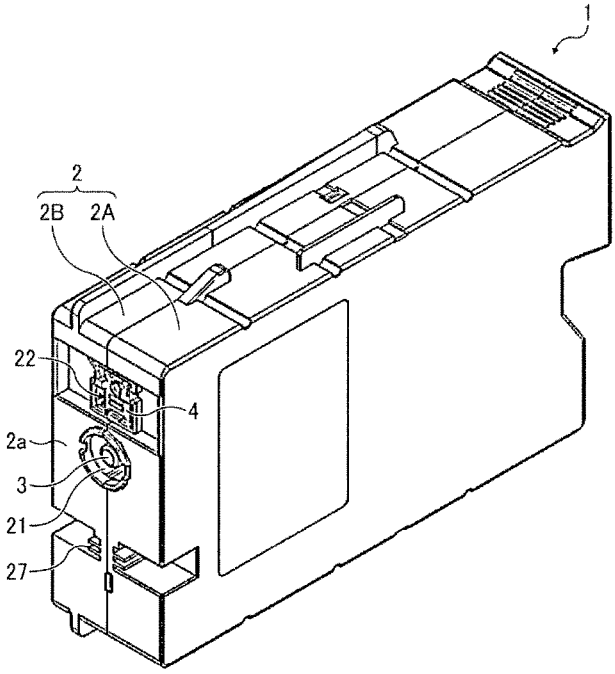
FIG. 1 is an outer perspective view of a liquid cartridge according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper but be, e.g., an OHP (overhead projector) sheet, a cloth sheet, a grass sheet, a substrate, or anything on which droplets of ink or other liquid can be adhered. In other words, the term "sheet" is used as a generic term including a recording medium, a recorded medium, a recording sheet, or a recording sheet of paper.

The term "image formation" is used as a synonym for "image recording" and "image printing". The term "image forming apparatus" refers to an apparatus that ejects ink or any other liquid onto a medium to form images on the medium. The medium is made of, for example, paper, string, fiber, cloth, leather, metal, plastic, glass, timber, and ceramic. The term "image formation". which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "ink" as used herein is not limited to "ink" in a narrow sense unless specifically distinguished and includes any types of liquid useable for image formation, such as recording liquid, fixing solution, DNA sample, resist, pattern material, and resin.

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

For a configuration of welding an ID chip serving as an information memory element and holding the ID chip, components of a liquid cartridge are assembled with a high degree of dimensional accuracy to prevent positional misalignment with a reading terminal of the apparatus body.

In such a case, it is conceivable that bisected case parts include an ID chip holding member for holding the ID chip. However, for such a configuration, the ID chip can be held in the cartridge case only when the cartridge case is assembled as a liquid cartridge.

In this case, there is no problem when a liquid replenishment process with respect to a liquid containing member contained inside of the cartridge case and assembling processes with respect to the case parts of the cartridge and the ID chip are performed within a series of processes. However, when the assembly of the cartridge case and the ID chip and the liquid replenishment are performed at different sites (such as factories), the case and the ID chip are separately packaged during the transportation between the sites.

For example, the case parts of the cartridge are formed into an incompatible shape for physically identifying a color or a type, and identification information on the color or type is recorded on the ID chip. However, the contents of the ID chip may not be visually judged from the outside appearance. As a result, when the cartridge is assembled in a state in which liquid is filled in the cartridge, an ID chip out of conformity with the type or shape of the cartridge may be erroneously combined during assembly.

Hence, according to at least one embodiment of this disclosure, even in a case where a face holding an information memory element is constituted of a case part that is split into at least two parts, the information memory element can be held for transportation in a state in which the case pans are separated.

A liquid cartridge according to a first embodiment of this disclosure is described with reference to FIGS. 1 to 5.

Figure 2:
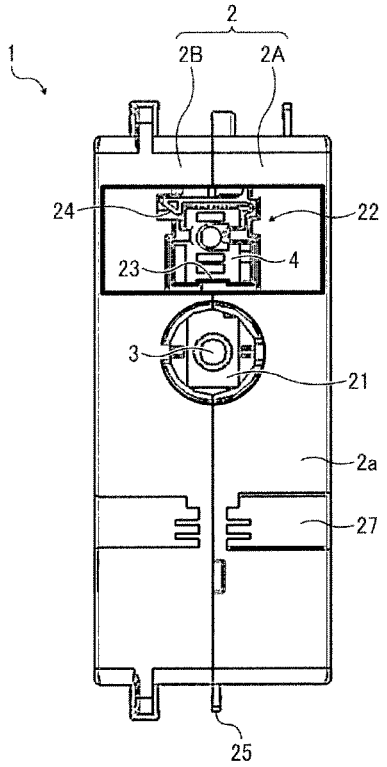
FIG. 2 is a front view of the liquid cartridge illustrated in FIG. 1.
Figure 3:
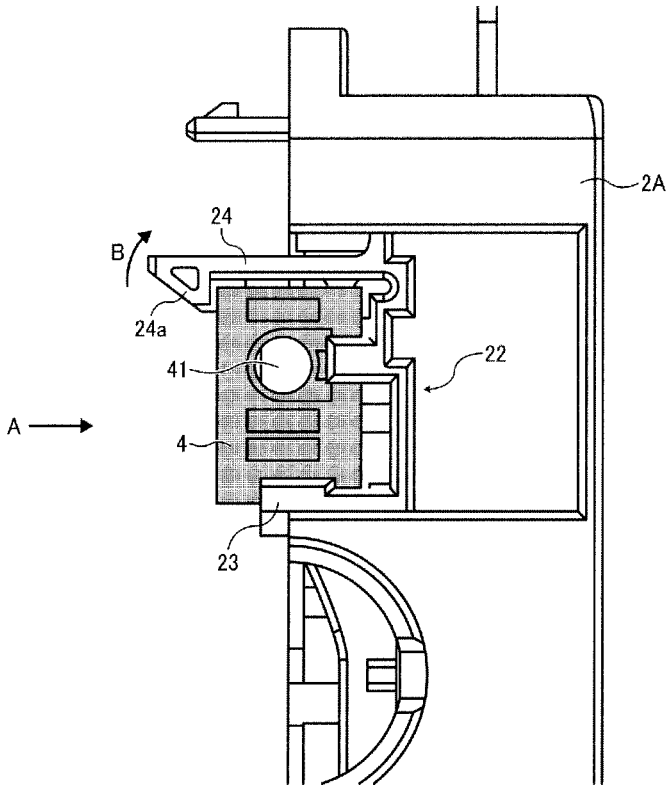
FIG. 3 is a front view of a chip holding unit of one case part of the liquid cartridge illustrated in FIG. 1.
Figure 4:
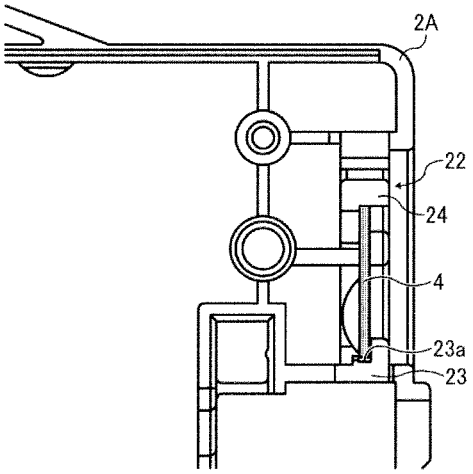
FIG. 4 is a side view of the chip holding unit on the left side of FIG. 3 according to the first embodiment of this disclosure.
Figure 5:
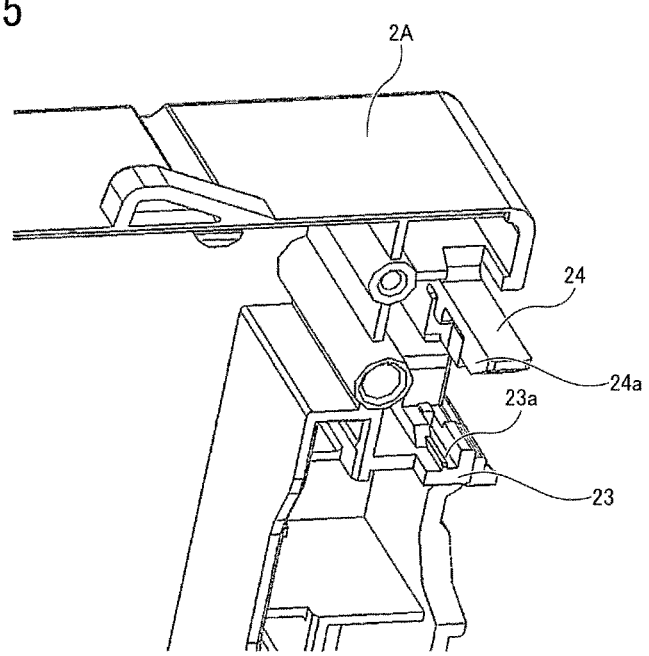
FIG. 5 is a partial perspective view of the liquid cartridge illustrated in FIG. 1.

FIG. 1 is an outer perspective of the liquid cartridge according to the first embodiment of this disclosure. FIG. 2 is a front view of the liquid cartridge according to the first embodiment of this disclosure. FIG. 3 is a front view explanatory of a chip holding unit for one case part according to the first embodiment of this disclosure. FIG. 4 is a view of the left side of FIG. 3 according to the first embodiment of this disclosure. FIG. 5 is a partial perspective view according to the first embodiment of this disclosure.

A liquid cartridge 1 has a cartridge case 2 serving as a case body to contain therein a liquid containing member such as a liquid container bag.

The cartridge case 2 has an opening portion 21, to which a supply port portion 3 of the liquid container bag contained therein is exposed, formed at a front face (a face in a direction in which the cartridge case 2 is disposed at an apparatus body) 2*a*.

Here, the cartridge case 2 is constituted of two case parts 2A and 2B that are split n a liquid supplying direction (i.e., a direction in which the cartridge case 2 is disposed at the apparatus body).

A chip holding unit 22 for holding an identification (hereinafter abbreviated as "ID") chip 4 is disposed at the front face of the case part 2A.

The chip holding unit 22 is provided with a chip mount groove 23 that retains the lower end of the plate-like and substantially rectangular ID chip 4 and a chip holding claw 24 serving as a displaceable snap-fit portion that presses the upper end of the ID chip 4 between the groove 23 and the same so as to hold the ID chip 4.

The groove 23 has a groove 23*a*, into which the ID chip 4 is fitted. The claw 24 has a hook-shaped projection 24*a* that projects downward so as to hook the ID chip 4, thereby holding the ID chip 4 at the case part 2A.

With this configuration, as shown in FIGS. 3 and 5, the ID chip 4 is inserted between the chip mount groove 23 and the chip holding claw 24 in a direction indicated by arrow A. At this time, the chip holding claw 24 is displaced in a direction indicated by arrow B, so that the chip 4 is fitted between the chip mount groove 23 and the chip holding claw 24. The chip holding claw 24 is returned to its original position, and thus, the projection 24*a* of the chip holding claw 24 locks the ID chip 4. Accordingly, the ID chip 4 is held between the chip mount groove 23 and the chip holding claw 24.

The ID chip 4 is fitted to the chip mount groove 23, and then. is held between the chip mount groove 23 and the chip holding claw 24, thus restricting the movement range of the ID chip 4 in one direction (in a direction in which the cartridge is disposed at the apparatus body) inside of the cartridge case 2.

Moreover, the holding unit 22 has the claw 24, and therefore, only one case part 2A can hold the ID chip 4 without any detachment from the cartridge case 2, and further, the ID chip 4 can move in a substantially planar direction within the holding unit 22. The planar direction signifies a direction alone a front face 2*a* of the cartridge case 2.

Consequently, the ID chip 4 can he held only by one case part 2A before the case part 2A is coupled as the cartridge case 2.

In this manner, even in the case where a face holding an information memory element is constituted of a case part that is split into at least two parts, the information memory element can be held for transportation in a state in which the case parts are separated.

In this embodiment, there are also provided a color identification rib 25 and a machine-type identifying shape portion 27 that are described below.

Next, a liquid cartridge according to an embodiment of this disclosure is explained with reference to FIG. 6.

Figure 6:
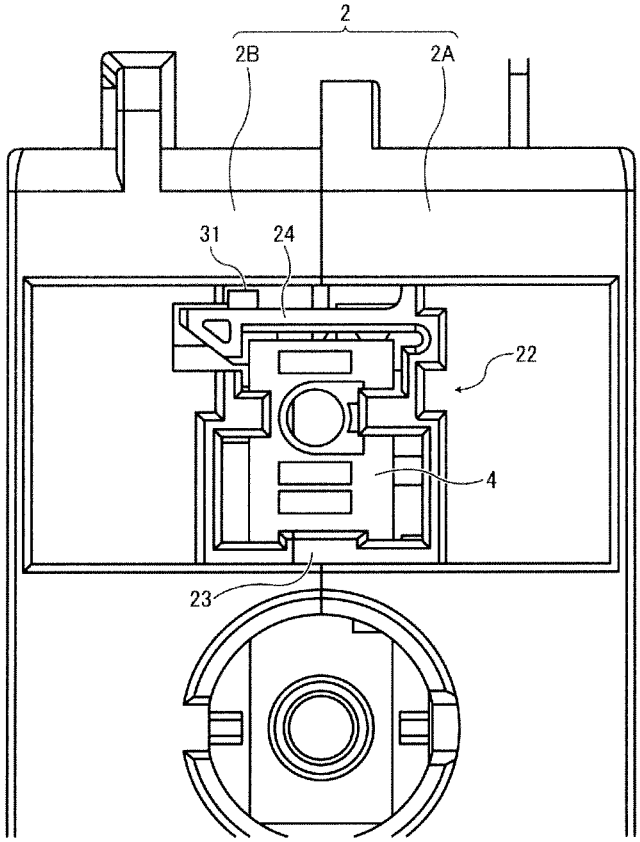
FIG. 6 is a front view of a chip holding unit of a liquid cartridge according to an embodiment of this disclosure.

FIG. 6 is a front view of a chip holding unit of a liquid cartridge according to this embodiment.

In this embodiment, a case part 2B having no chip holding unit 22 is provided with a displacement restricting portion 31 to restrict a displacement of a claw 24 when the case part 2B is assembled with another case part 2A.

In this manner, in a state in which a cartridge case 2 is assembled, the claw 24 of the chip holding unit 22 is restricted by the displacement restricting portion 31, and thus, is prevented from being displaced.

Consequently, when a liquid cartridge 1 is mounted in an apparatus body and is used, deformation of the claw 24 is prevented, so that the movable range of an ID chip 4 is kept at a proper position.

Next, a displacement amount of the claw of the chip holding unit described with reference to FIGS. 7 and 8.

Figure 7:
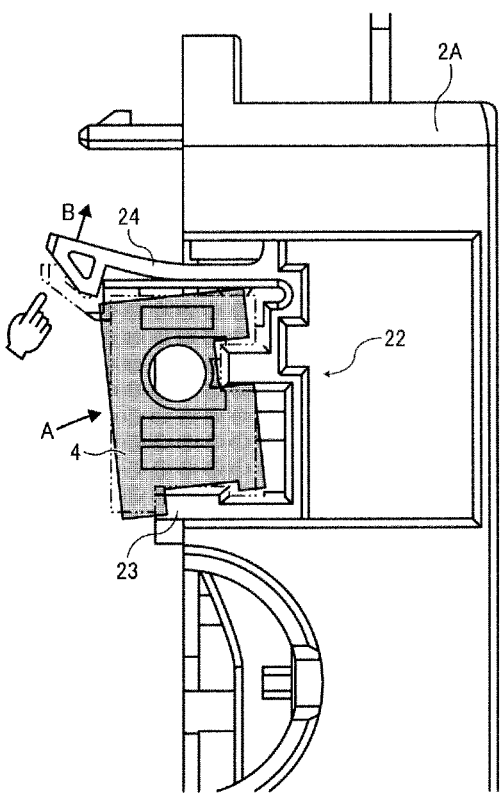
FIG. 7 is a front view of the chip holding unit illustrated in FIG. 6 with a claw at a displacement amount.
Figure 8:
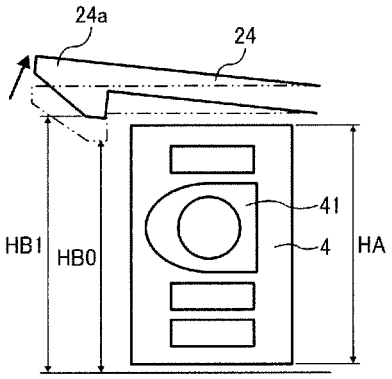
FIG. 8 is a view of relationship between the claw illustrated in FIG. 7 and an ID chip according to an embodiment of this disclosure.

FIG. 7 is a front view of the chip holding unit with the claw. FIG. 8 is a view of a relationship between the claw and the ID chip.

When the height HA of the outer shape of the ID chip 4 is smaller than the height HB1 of an opening formed at a position at which the claw 24 of the chip holding unit 22 is pushed up so that the opening is enlarged, the ID chip 4 can be attached and detached.

By contrast, when the height HA of the outer shape of the ID chip 4 is greater than the initial height HB0 of the claw 24, the ID chip 4 is held between a groove 23 and the claw 24.

As a consequence, the law 24 can he displaced within a range satisfying the above-described relationship.

Next, reading of the ID chip 4 is described with reference to FIGS. 9A and 9B.

Figure 9B:
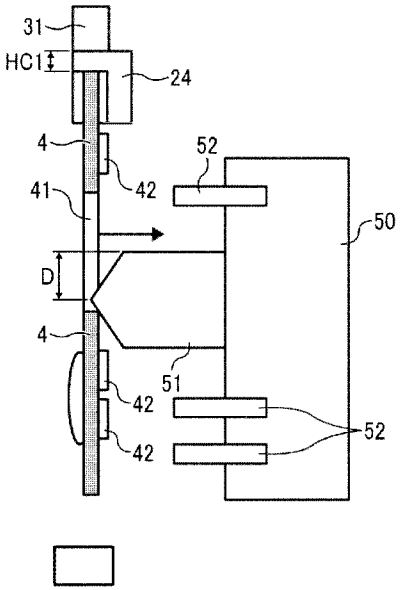
FIGS. 9A and 9B are partial cross-sectional views of reading of the ID chip illustrated in FIG. 8.
Figure 9A:
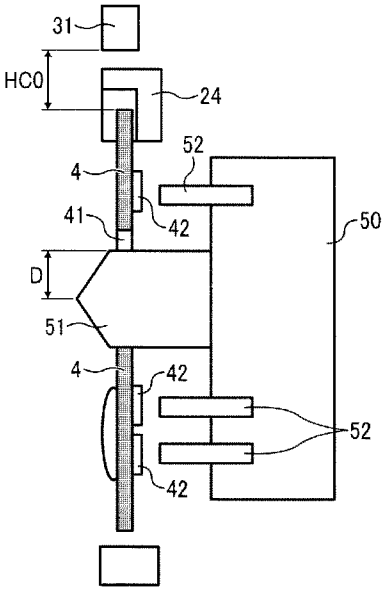

FIGS. 9A and 9B are partial cross-sectional views of reading of the ID chip.

On the side of the apparatus body is disposed a reading unit 50 having a guide portion 51 that can be inserted into a guide hole 41 formed at the ID chip 4.

When the liquid cartridge 1 is inserted into the apparatus body, the guide portion 51 of the reading unit (i.e., a connector) 5 is inserted into the guide hole 41 of the ID chip 4, so that the ID chip 4 is moved in a planar manner along the guide portion 51.

In this way, reading terminals (i.e., connectors) 52 of the reading unit 50 are brought into contact with contact portions 42 of the ID chip 4, and thus, information stored in the ID chip 4 can be read on the side of the apparatus body.

Here, a tapered portion for guiding is formed at the guide portion 51 to be inserted into the guide hole 41. In comparison between a radius D from the axial center of the guide portion 51 to its outer diameter and a distance HC1 between the end portion of the ID chip and the displacement restricting portion 31 of the claw 24 in abutment against the upper end of the ID chip 4, when HC1<D, the ID chip 4 is fitted into the guide portion 51 owing to the guidance (tapered) shape of the guide portion 51, thereby securing a position at which the contact portion 42 and the reading terminal 52 are properly located.

In the state in which the cartridge case 2 is assembled, the displacement restricting portion 31 restricts the displacement amount of the claw 24, thus maintaining the relationship of HC1<D.

Next, a liquid cartridge according to an embodiment of this disclosure is described with reference to FIGS. 10 and 11.

Figure 10:
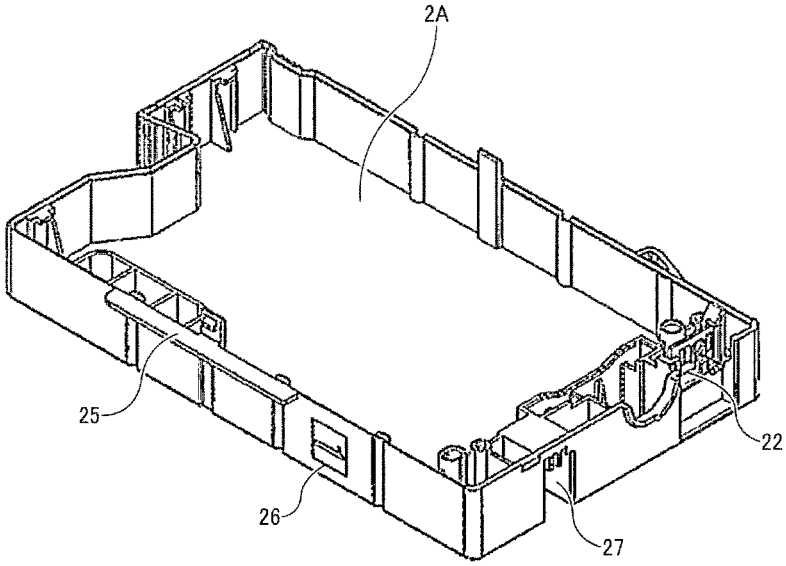
FIG. 10 is a perspective view of one case part of a liquid cartridge according to a third embodiment of this disclosure.
Figure 11:
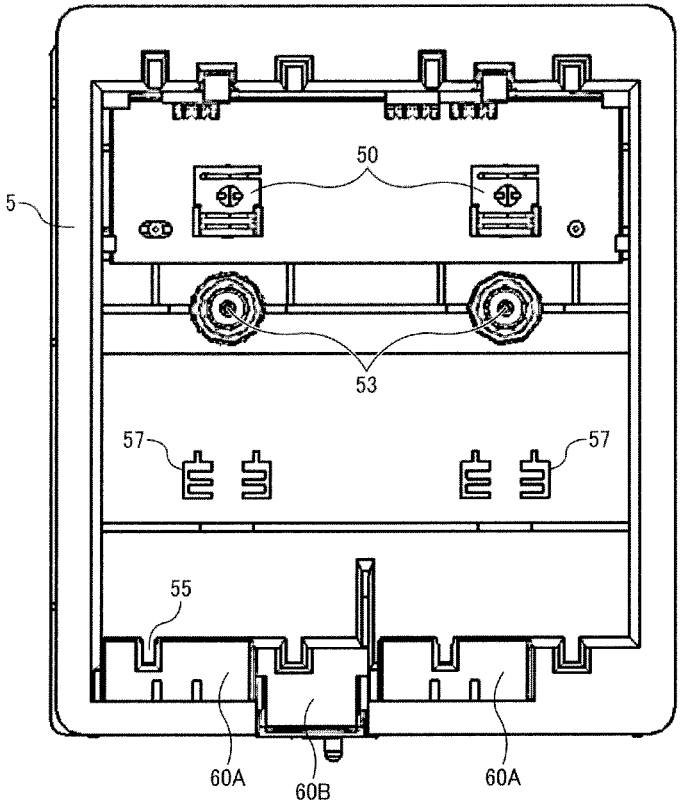
FIG. 11 is a front view of a cartridge mounting section (i.e., a cartridge holder) of an apparatus body, on which the liquid cartridge is to be mounted, according to an embodiment of this disclosure.

FIG. 10 is a perspective view of one case part of a liquid cartridge according to this embodiment. FIG. 11 is a front view of a cartridge mounting section (i.e., a cartridge holder) of an apparatus body, on which the liquid cartridge is mounted, according to an embodiment of this disclosure.

On the bottom side of a case part 2A having a chip holding unit 22 is disposed a color identification rib 25 for identifying the type of liquid contained in a liquid containing portion housed therein, for example, the color of ink in a mounting direction. Moreover, a predetermined color identification number 26 is attached to a surface, at which the color identification rib 25 is disposed.

Additionally, a machine-type identifying shape portion 27 indicating the type (i.e., a machine-type) of an apparatus body provided with a liquid cartridge 1 is formed at the front face of the case part 2A having the chip holding unit 22. The machine-type identifying shape portion 27 is a recess of a shape according to a machine type.

In the meantime, a cartridge holder 5 for the apparatus body is provided with the above-described reading units 50 at a back face (i.e., a face opposite to the front face of the liquid cartridge 1). Furthermore, there are provided supply ports 53 such as a needle connected to a supply port portion 3 for the liquid cartridge 1.

In addition, a color identification groove (i.e., a recess) 55, to which the color identification rib 25 is fitted at a position according to a color, is formed at the cartridge holder 5 in an insertion direction of the liquid cartridge 1. When the liquid cartridge 1 is mounted with the proper color of the liquid cartridge 1, the color identification rib 25 can be fitted to the color identification groove 55.

Moreover, other machine-type identifying shape portions 57 indicating machine types are disposed at the back face of the cartridge holder 5, When the liquid cartridge 1 can be mounted with a proper machine type, the machine-type identifying shape portion 27 is fitted to the machine-type identifying shape portion 57.

Here, the relationship between the color identification rib and the color identification groove (i.e., the recess) and the relationship between the machine-type identifying shape portions may be reverse to those in this embodiment with respect to the liquid cartridge 1 and the cartridge holder 5 for the apparatus body.

With the above-described configuration, even in the case where the site in which the cartridge case 2 for the liquid cartridge 1 and the ID chip 4 are fabricated and the site in which the liquid containing member is filled with the liquid (i.e., the ink) and then assembled are different from each other, the members are transported between the sites in the state in which the information on the machine type and ink color held in the ID chip 4 is identical to the incompatible shape of the machine type and ink color of the case part 2A. Such a configuration prevents a mounting error of the ID chip 4 and the cartridge case 2 in an assembling process after the cartridge is filled with the ink.

Figure 12:
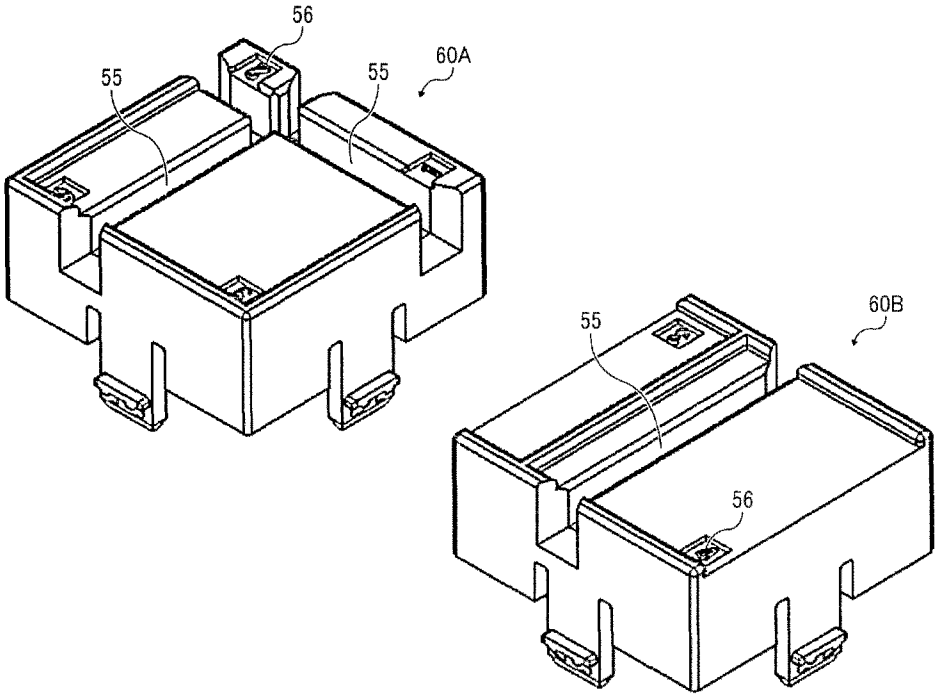
FIG. 12 is a perspective view of a color identifying ember forming a color identification groove at the cartridge holder according to an embodiment of this disclosure.

Here, a description is given of one example of the color identifying member forming the color identification groove 55 of the cartridge holder 5 with reference to FIG. 12.

FIG. 12 is a perspective view of a color identifying member according to an embodiment of this disclosure.

A color identifying member 60A is a block member that can be mounted in a plurality of different mounting directions. The color identification grooves 55 serving as slits for guiding the incompatible color identification rib 25 disposed in the liquid cartridge 1 are formed at the block member in a crossing manner. In this mariner, the mounting direction is changed, so that different liquid cartridges 1 can be guided by the color identification grooves 55.

Moreover, the color identification grooves 55 serving as slits for guiding the incompatible color identification rib 25 disposed in the liquid cartridge 1 are formed at a color identifying member 60B at positions at different distances from both ends. Consequently, different liquid cartridges 1 can be guided by the color identification grooves 55 by varying the mounting direction.

A color identification number 56 indicating the relationship between the mounting direction and the color is attached to each of the color identifying members 60A and 60B.

As a consequence, it is possible to readily vary the arrangement order or color configuration of the liquid cartridge.

Figure 14:
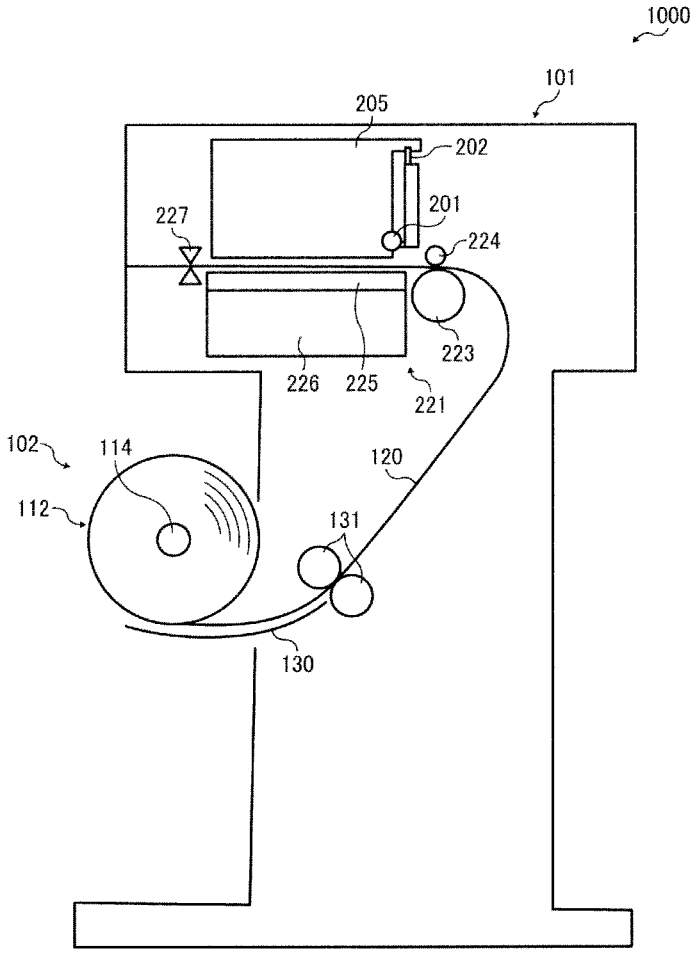
FIG. 14 is a schematic side view of the image forming apparatus of FIG. 13.
Figure 15:
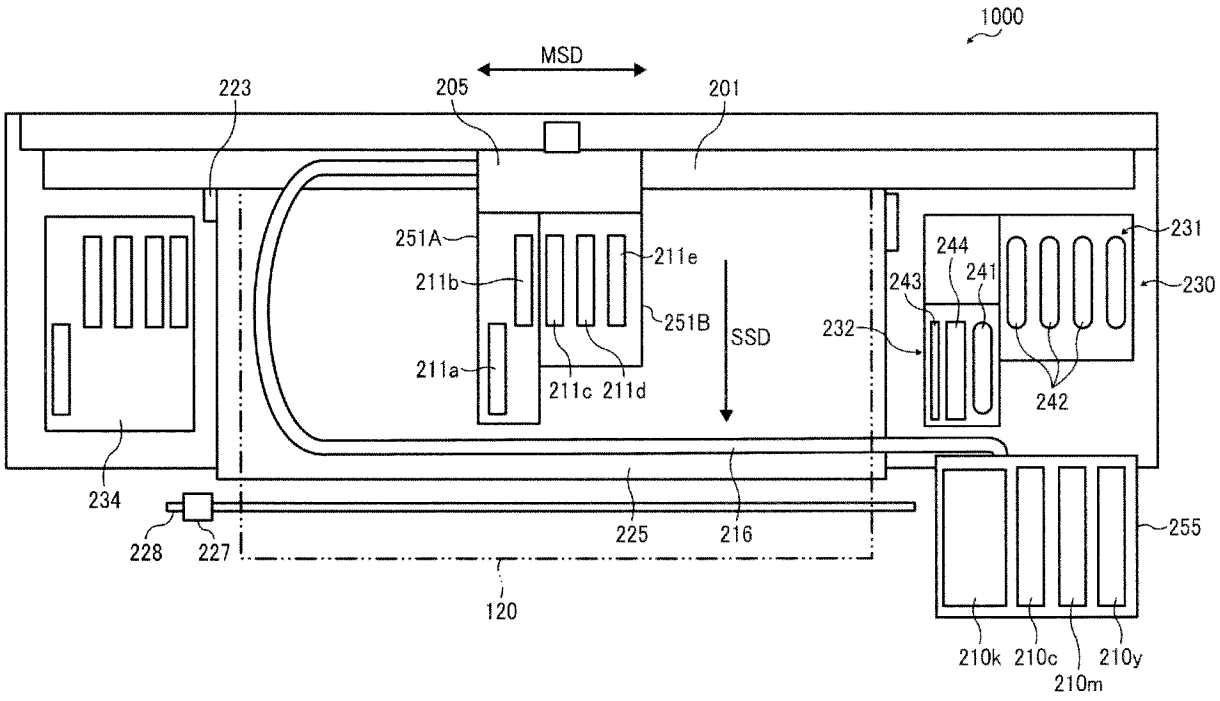
FIG. 15 is a partial plan view of an image forming unit of the image forming apparatus of FIG. 13.

Next, an image forming apparatus according o an embodiment of this disclosure is described with reference to FIGS. 13 to 15.

Figure 13:
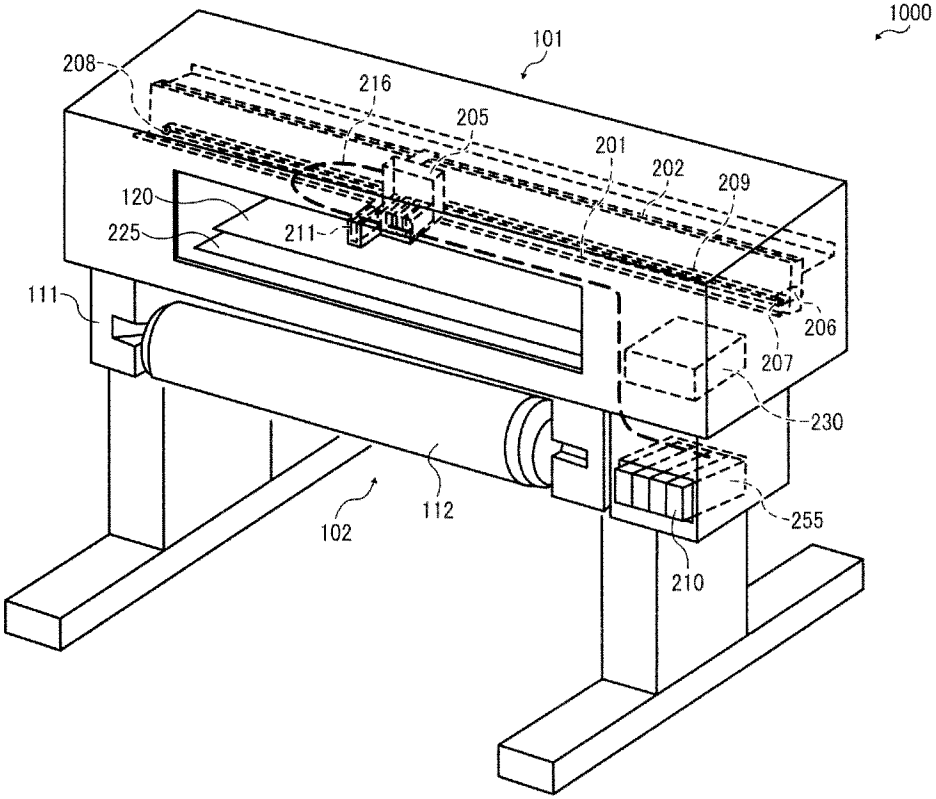
FIG. 13 is an outer perspective view of an image forming apparatus according to an embodiment of this disclosure.

FIG. 13 is an outer perspective view of the image forming apparatus according to this disclosure. FIG. 14 is a schematic side view of the image forming apparatus illustrated in FIG. 13. FIG. 15 is a partial plan view of an image forming unit of the image forming apparatus illustrated in FIG. 13.

An image forming apparatus 1000 according to this embodiment is of a serial type including an apparatus body 101 and a sheet feeding device 102 disposed under the apparatus body 101.

Inside of the apparatus body 101, a guide rod 201 and a guide stay 202 that serve as guide members are disposed across both side plates. A carriage 205 is movably held in the guide rod 201 and the guide stay 202 in a main scanning direction indicated by arrow MSD in FIG. 15.

The carriage 205 makes a reciprocating motion in the main scanning direction MSD via a drive pulley 207, a driven pulley 208, and a timing belt 209 by a main scanning motor 206.

The carriage 205 mounts thereon recording heads 211*a* to 211*e* (referred to as "a recording head 211" when they need not be distinguished), in which a plurality of liquid ejection heads for ejecting ink droplets are integrated with head tanks for supplying the liquid to liquid ejection heads. Incidentally, the recording heads 211*a* and 211*b* are held by a head holder 251A whereas the recording heads 211*c* to 211*e* are held by another head holder 251B.

Here, the recording head 211*a* and the recording heads 211*b* to 211*e* are shifted by one head (i.e., one nozzle array) in a sub scanning direction (indicated by arrow SSD in FIG. 15) perpendicular to the main scanning direction MSD. Each of the recording heads 211*a* to 211*e* has two nozzle arrays. Each of the recording heads 211*a* and 211*b* is adapted to eject liquid droplets of the same black color whereas the recording heads 211*c* to 211*e* are adapted to eject liquid droplets of magenta (M), cyan (C), and yellow (Y), respectively.

In this manner, a monochromatic image can be formed in a width corresponding to two heads by one scanning (i.e., one main scanning) by using the recording heads 211*a* and 211*b*: in contrast, a color image can he formed by, for example, the recording heads 211*b* to 211*e*. Here, the head configuration is not limited to this, but a plurality of recording heads may be all arranged in the main scanning direction MSD.

To a head tank in the recording head 211 is supplied ink of each color via a bendable supply tube 216 from ink cartridges 210*k*, 210*c*, 210*m*, and 210*y* (referred to as "an ink cartridge 210" when they need not be distinguished) serving as the liquid cartridges according to this disclosure. At this time, the ink is supplied to the two recording heads 211*a* and 211*b* for ejecting the droplets of the same color from one and the same ink cartridge 210*k*.

The ink cartridge 210 is detachably attached to a cartridge holder 255 that is similar to the cartridge holder 5 disposed in the apparatus body, as described in the third embodiment.

A roll sheet 120 is fed from the sheet feeding device 102 in a recording area in the main scanning area of the carriage 205, and then, it is intermittently conveyed in a direction perpendicular to the main scanning direction MSD of the carriage 205 (i.e., the sub scanning direction SSD) by a conveyance unit 221.

The conveyance unit 221 includes a conveyance roller 223 and a pressing roller 224 disposed opposite to the conveyance roller 223, each of the rollers being a rotary body for conveying the roll sheet 120 serving as a roll-like medium to be fed from the sheet feeding device 102. Moreover, the conveyance unit 221 includes a conveyance guide member 225 having a plurality of suction holes formed thereat and a suction fan 226 serving as a suction unit for performing suction from the suction holes formed at the conveyance guide member 225.

Downstream of the conveyance unit 221 is disposed a cutter 227 serving as a cutting unit or cutting the roll sheet 120 having an image formed thereon by the recording head 211 in a predetermined length.

The cutter 227 is mounted at, for example, a wire or a timing belt 228. When the belt 228 is moved in the main scanning direction MSD, the roller sheet 120 is cut at a predetermined position by the cutter 227.

Furthermore, a maintenance assembly 230 for maintaining the recording head 211 sideways of the conveyance guide member 225 is disposed on one side in the main scanning direction MSD of the carriage 205. In the meantime, a dummy-ejection receptacle 234 for performing dummy ejection in which droplets not contributive to image formation are ejected from the recording head 211 sideways of the conveyance guide member 225 is disposed on the other side in the main scanning direction MSD.

The maintenance assembly 230 includes a first maintenance unit 231 held in a frame member of the apparatus body 101 and a second maintenance unit 232 held in a frame member of the maintenance assembly 230 in such a manner as to freely reciprocate in the sub scanning direction SSD. The second maintenance unit 232 is located at a position shown in FIG. 15 when it maintains the recording head 211*a*: in contrast, it is moved to the same position in the sub scanning direction SSD as that of the first maintenance unit 231 when it maintains the recording heads 211*b* to 211*e*.

The maintenance assembly 230 is provided with a suction cap 241 serving as a moisture-retention cap for capping, for example, a nozzle face (a face at which a nozzle is formed) of the recording head 211 and moisture-retention caps 242. Additionally, the maintenance assembly 230 is provided with a wiper member 243 for wiping the nozzle face, another dummy-ejection receptacle 244 for receiving droplets (dummy-ejection droplets) not contributive to the image formation, and the like.

The sheet feeding device 102 has a spool bearing table 111. Inside of the spool bearing table 111 is disposed a feeding mechanism for feeding the roll sheet 120 from a media roll 112 and then rewinding the roll sheet 120.

A sheet (the above-described "roll sheet") 120 serving as an elongated roll-like medium is wound around a pipe 114 as a core member in a roll-like manner, thereby obtaining the media roll 112. Here, the media roll 112 is the general term for a member having the tube 114 and the roll sheet 120 in combination.

When the media roll 112 disposed at the spool bearing table 111 is rotated, the roll sheet 120 is fed downstream along a guide member 130.

A conveyance roller pair 131 for upward feeding the roll sheet 120 fed from the media roll 112 in a curved manner is disposed at the spool bearing table 111 downstream in a feeding direction. The guide member 130 for guiding the lower surface of the roll sheet 120 is interposed between the spool bearing table 111 and the conveyance roller pair 131.

When the conveyance roller pair 131 is rotatably driven, the roll sheet 120 fed from the media roll 112 is conveyed by the conveyance roller pair 131, to be fed to between the conveyance roller 223 and the pressing roller 224 in the conveyance unit 221 via the conveyance roller pair 131.

In the image forming apparatus such configured as described above, the roll sheet 120 fed from the sheet feeding device 102 is intermittently conveyed by the conveyance unit 221. Thereafter, the carriage 205 is moved in the main scanning direction MSD, and then, the recording head 211 is driven according to image information (print information) to eject droplets, so that a required image is formed on the stationary roll sheet 120.

The roll sheet 120 having the image formed thereon is cut at a predetermined position by the cutter 227, and then, is discharged onto a discharge tray disposed on the front side of the apparatus body 101.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to he regarded as a departure from the scope of the present disclosure and appended claims, and all such modifications are intended to be included within the scope of the present disclosure and appended claims.

What is claimed is:

1. A liquid cartridge detachably attachable to an apparatus body of an image forming apparatus, the liquid cartridge comprising:

a cartridge case including at least two dividable case parts, the at least two dividable case parts forming a front face of the cartridge case to face the apparatus body when the liquid cartridge is attached to the apparatus body;

an information memory element held at the front face of the cartridge case; and a holding unit provided in one of the at least two dividable case parts to hold the information memory element with only the one of the at least two dividable case parts, the holding unit including a groove to receive the information memory element and a displaceable claw to hold the information memory element between the groove and the claw.

2. The liquid cartridge according to claim 1, wherein another one of the at least two dividable case parts includes a restricting portion to restrict displacement of the claw of the one of the at least two dividable case parts.

3. The liquid cartridge according to claim 1, wherein the one of the at least two dividable case parts includes an identification rib to identify a type of liquid contained in the one of the at least two dividable case parts.

4. The liquid cartridge according to claim 1, wherein the one of the at least two dividable case parts includes an identification groove to identify a type of liquid contained in the one of the at least two dividable case parts.

5. The liquid cartridge according to claim 1, wherein the one of the at least two dividable case parts includes an identifying shape portion having a shape to identify a type of the apparatus body to which the liquid cartridge is to be attached.

6. An image forming apparatus, comprising:

an apparatus body; and a liquid cartridge detachably attached to the apparatus body, the liquid cartridge including a cartridge case including at least two dividable case parts, the at least two dividable case parts forming a front face of the cartridge case to face the apparatus body when the liquid cartridge is attached to the apparatus body, an information memory element held at the front face of the cartridge case, and a holding unit provided in one of the at least two dividable case parts to hold the information memory element with only the one of the at least two dividable case parts, the holding unit including a groove to receive the information memory element and a displaceable claw to hold the information memory element between the groove and the claw.

* * * * *

UNITED STATES PATENT AND TRADEMARK OFFICE

CERTIFICATE OF CORRECTION

PATENT NO. : 9,039,152 B2
APPLICATION NO. : 14/471180
DATED : May 26, 2015
INVENTOR(S) : Yoichi Kawabata et al.

It is certified that error appears in the above-identified patent and that said Letters Patent is hereby corrected as shown below:

Replace item (54) on the title page of the patent, with the following:

--(54) LIQUID CARTRIDGE AND IMAGE FORMING APPARATUS INCORPORATING SAME--.

Specification

Replace title at column 1, lines 1-2, with the following:

--LIQUID CARTRIDGE AND IMAGE FORMING APPARATUS INCORPORATING SAME--.

Signed and Sealed this
Ninth Day of February, 2016

Michelle K. Lee

Michelle K. Lee
*Director of the United States Patent and Trademark Office*